United States Patent [19]

Wognum

[11] Patent Number: 4,726,416

[45] Date of Patent: Feb. 23, 1988

[54] METHOD AND APPARATUS FOR CONTINUOUS CASTING OF METAL

[76] Inventor: James N. Wognum, 9309 S. Pleasant Ave., Chicago, Ill. 60620

[21] Appl. No.: 923,895

[22] Filed: Oct. 28, 1986

[51] Int. Cl.[4] ..... B22D 11/124

[52] U.S. Cl. ..... 164/485; 164/443

[58] Field of Search ..... 164/416, 418, 443, 444, 164/485, 486, 487; 164/414, 455

[56] References Cited

U.S. PATENT DOCUMENTS 3,166,803 1/1965 Ruckstuhl ..... 164/416

3,258,815 7/1966 Reinfeld et al. ..... 164/416

FOREIGN PATENT DOCUMENTS 1955746 5/1971 Fed. Rep. of Germany ..... 164/443

879437 10/1961 United Kingdom ..... 164/418

*Primary Examiner*—Nicholas P. Godici

*Assistant Examiner*—Richard K. Seidel

*Attorney, Agent, or Firm*—Anthony S. Zummer

[57] ABSTRACT

The present invention relates to an improved apparatus and method for continuous casting of metal into an elongated bar. The apparatus includes an elongated vertical corrugated mold sleeve adapted for receiving molten metal. Means are connected to the sleeve for chilling the metal within the sleeve and intermittently compressing the sleeve to place the interior of the sleeve into frictional engagement with the metal within the sleeve. The sleeve is intermittently released and moved in a direction opposite the direction of movement of the solidified metal.

26 Claims, 3 Drawing Figures

16
67
66
68
70
64
62
67
14
54
56
10
58
60
108
112
114
42
12
40
34
36
32
110
44
102
38
30
19
28
104
52
48
46
106
52
50
104
18
106
COOLANT IN
89
86
89
20
82
84
88
98
94
COOLANT OUT
3
3
90
26
96
92
94
24
22
24

METHOD AND APPARATUS FOR CONTINUOUS CASTING OF METAL

BACKGROUND OF THE INVENTION

The continuous casting of metals is well known. A known process of continuous casting includes the steps of; pouring molten metal into one end of a sleeve type mold, solidifying a shell of the casting in the mold, and removing that solidified shell through the other end of the sleeve. The solidified metal is ordinarily pulled out of the sleeve mold by rolls. One of the problems which is common to continuous casting of metals into a continuous elongated bar is the rupture of the solidified shell of the casting so that the molten metal from the interior of the casting flows out. Such a rupture prior to solidification of the metal within the shell results in a disruption of the entire continuous casting process. Various means have been designed to prevent rupture of the shell of the casting while the shell has a low tensile strength. These various means recognize the problem of frictional resistance of the casting against the mold as the shell progresses through the mold which, in some instances, causes rupture of the shell.

U.S. Pat. Nos. 2,135,183 to Junghans, 2,815,551 to Hessenberg et al, 3,025,579 to Littlewood, 3,040,397 to Haussner et al., 3,088,181 to Littlewood et al., 3,118,195 to Gouzou et al., 3,258,815 to Reinfeld, and 3,307,230 to Goss all teach axial movement of the mold relative to the casting in a continuous casting process. Each patent teaches an individual program sequence of axial movements induced by a suitable control of electrical, hydraulic or other means.

U.S. Pat. No. 3,397,733 to Gricol teaches vibration of the casting by lateral impact against the cast surface while the casting exits from the mold which is not oscillating axially or laterally.

U.S. Pat. No. 3,565,158 to Ciochetto teaches lateral vibration of the mold wall to improve metallurgical properties of the casting.

U.S. Pat. No. 3,415,306 to Olsson teaches a nozzle fitted telescopically into a mold sleeve so that molten metal enters the mold while the mold and the casting within it move axially away from the nozzle. The mold is then moved toward the nozzle while a flat end portion of the nozzle is abutted directly against the solidified shell of the casting to urge compressively the casting to move axially toward the exit end of the mold.

U.S. Pat. No. 3,612,157 to Brock teaches a casting sleeve oscillated axially within an outer cooling water jacket. Means are provided by Brock for applying gas pressure against the top surface of the liquid metal in the mold and surrounding the immersed end of the nozzle, thus controlling flow of liquid metal into the mold.

U.S. Pat. No. 4,340,110 to Honda et al teaches an apparatus for connecting a tundisn to a mold for horizontal continuous casting.

U.S. Pat. No. 3,528,485 to Vogel shows a mold in two halves separated by an axial plane and held firmly together during the casting operation. The halves are separated to allow the trailing end of the finished casting to pass through the mold with minimum friction and thus avoid containment of remnants of the cast shell within the mold following completion of the casting operation.

U.S. Pat. Nos. 3,075,264; 3,483,918; 3,528,487; and 3,672,436 to Wognum teach multiple longitudinal sections of water cooled bars, each bar mitered to fit tightly against the adjacent bar and thus form a longitudinal mold cavity for casting of molten metals and alloys. Wognum provides drive mechanisms to impart axial and transverse movements to each of the sections in phased relationship to cause a casting to be propelled through the mold without external withdrawing means and without frictional resistance, thus minimizing rupture of the low strength shell of the casting during solidification.

SUMMARY OF THE INVENTION

The present invention relates to an apparatus and a method for continuous casting of metal into an elongated bar. The apparatus includes an elongated vertical mold sleeve having one end adapted for receiving molten metal. The mold sleeve is an elongated open ended cylinder having an elongated longitudinal axis. The cylinder has a continuous interior side wall particularly adapted for engaging metal cast in the cylinder while said metal moves substantially parallel to the elongated longitudinal axis. Means are provided for connecting a support for the cylinder to the cylinder. Means are connected to the cylinder for delivering a coolant into contact with the exterior of the cylinder for cooling the cylinder to chill metal within the sleeve to solidify the metal adjacent to the sleeve. Conventional means are connected to the solidified metal leaving the cylinder for moving the metal out of the mold sleeve. Means are also provided for creating pulsing rhythmical pressure variations in the coolant adjacent to the cylinder to cause rhythmic radial vibration of the sleeve wall against the solidified shell of metal cast in the sleeve. The radial vibrations of the sleeve wall places the interior of the sleeve into alternate increased an decreased frictional engagement with the metal within the sleeve. Means are connected to the sleeve for moving the mold sleeve relative to the metal within the sleeve in a direction opposite to the direction of movement of the solidified metal when the frictional engagement between the sleeve and the casting is decreased.

The process includes pulsing rhythmic pressure variations of the coolant against the outer surface of the mold sleeve to cause rhythmic radial vibration of the sleeve wall against the solidifying shell of metal cast within the sleeve. Radial movement of the sleeve wall effects the frictional force between the cast metal and the interior sleeve wall. An increase in frictional force between the sleeve and casting causes the sleeve to move with the cast metal and reduction of that frictional force as a result of expansion of the sleeve with reduction of the pressure allows the sleeve to move relative to the cast metal. The intermittent holding and releasing of the cast metal minimizes the likelihood of fracture of the hot and low strength shell of the casting. The sequence of movement of the sleeve yields other benefits, namely, less wear on the inner surface of the sleeve, increased rate of heat transfer to the coolant, and finer metallurgical grain structure within the casting.

DESCRIPTION OF THE PREFERRED EMBODIMENT

Figure 1:
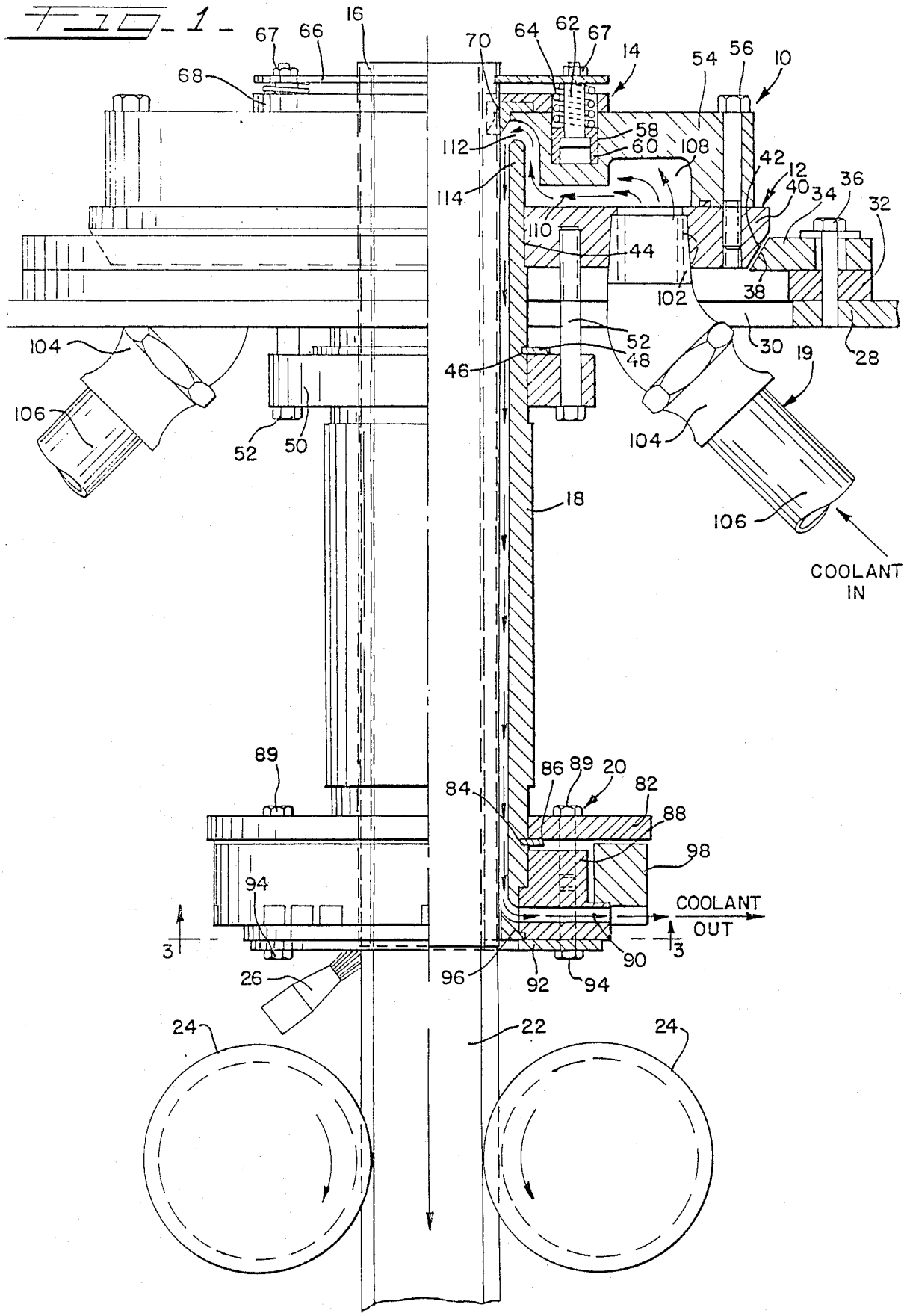
FIG. 1 is a side elevational view of an apparatus embodying the herein disclosed invention with a portion shown in cross section to show better the interior relationship of the parts.

Referring now to the drawings and especially to FIG. 1, an apparatus for continuous casting of metal into an elongated bar, which apparatus is a specific embodiment of the instant invention, is shown therein and generally indicated by numeral 10. Apparatus 10 generally includes a jacket supoort 12 having a sleeve support assembly 14 mounted thereon. An elongated vertical mold casting sleeve 16 is connected to the sleeve support assembly and is supported thereby. A coolant jacket 18 is connected to the jacket support and surrounds sleeve 16 to retain a coolant adjacent to the exterior surface of the sleeve for substantially the entire length of the sleeve. A coolant inlet assembly 19 is connected to jacket support 12 to deliver coolant, in this instance water, under pressure to jacket support 12 and the interior of jacket 18. A coolant outlet control 20 is connected to the bottom of coolant jacket 18 to regulate the flow of coolant out of the coolant jacket.

As is conventional, molten metal is poured into the upper end of the sleeve. The sleeve and molten metal are chilled by a coolant adjacent to the outer surface of the sleeve thereby causing the metal adjacent to the sleeve to solidify and form an elongated bar 22. The outer surface of the bar solidifies to form a shell while the interior remains molten. Bar 22 is pulled out of sleeve 16 by conventional withdrawal rolls 24. Although only a pair of withdrawal rolls 24 is shown herein, it is well known in the art to have a multiplicity of pairs of withdrawal rolls. Bar 22 is further cooled by coolants sprayed from a multiplicity of coolant nozzles 26 positioned below the coolant outlet control. The further cooling causes the interior of the bar to solidify.

A support platform 28 which is connected to a manufacturing floor (which manufacturing floor is not shown), includes an opening 30 to receive a portion of apparatus 10. A base ring 32 is mounted on platform 28 with an attachment ring 34 mounted on the base ring. A plurality of machine screws 36 extend through attachment ring 34 and base ring 32. Screws 36 are threadedly mounted in platform 28 to secure the attachment ring and the base ring to the platform. The attachment ring is a portion of jacket support 12 and includes a beveled aperture 38 which receives a jacket support plate 40. The jacket support plate includes a beveled outer edge 42 which is engageable with and supported in the beveled aperture 38 so that the jacket support plate may be moved adjustably relative to attachment ring 34. The coolant jacket 18 has its upper end mounted in a jacket aperture 44 in the jacket support plate. The coolant jacket has on its outer surface an annular lock ring groove 46 with a conventional lock ring 48 mounted therein. A support ring 50 receives jacket 18 and engages lock ring 48. Support ring 50 is secured to jacket support plate 40 by a plurality of bolts 52. The coolant jacket is suspended from the jacket support plate so that the main portion of the jacket is positioned below the support plate. The vertical attitude of the jacket may be selectively adjusted by pivoting the jacket support plate in adjustment ring 34.

Sleeve support assembly 14 includes a header 54 which is secured to the jacket support plate by a plurality of support bolts 56. The header includes a plurality of guide pin recesses 58. Each of the guide pin recesses includes a guide pin retainer 60 adjacent to the bottom of the recess with a guide pin 62 in each guide pin recess. A support spring 64 is mounted on each of the guide pins. A support disk 66 having a plurality of guide pin apertures 65 is mounted on the guide pins with each guide pin positioned in a respective pin aperture. A conventional nut 67 is threadedly mounted on each of the guide pins to secure the support disk to the guide pins. The support disk is constantly urged upward by the supoort springs 64. The sleeve is releasably connected to support disk 66. A guide disk 68 is mounted on header 54. A hydraulic packing 70 is positioned between the guide disk and the header and the outer periphery of the sleeve to seal closed the space between the sleeve and the header.

Figure 2:
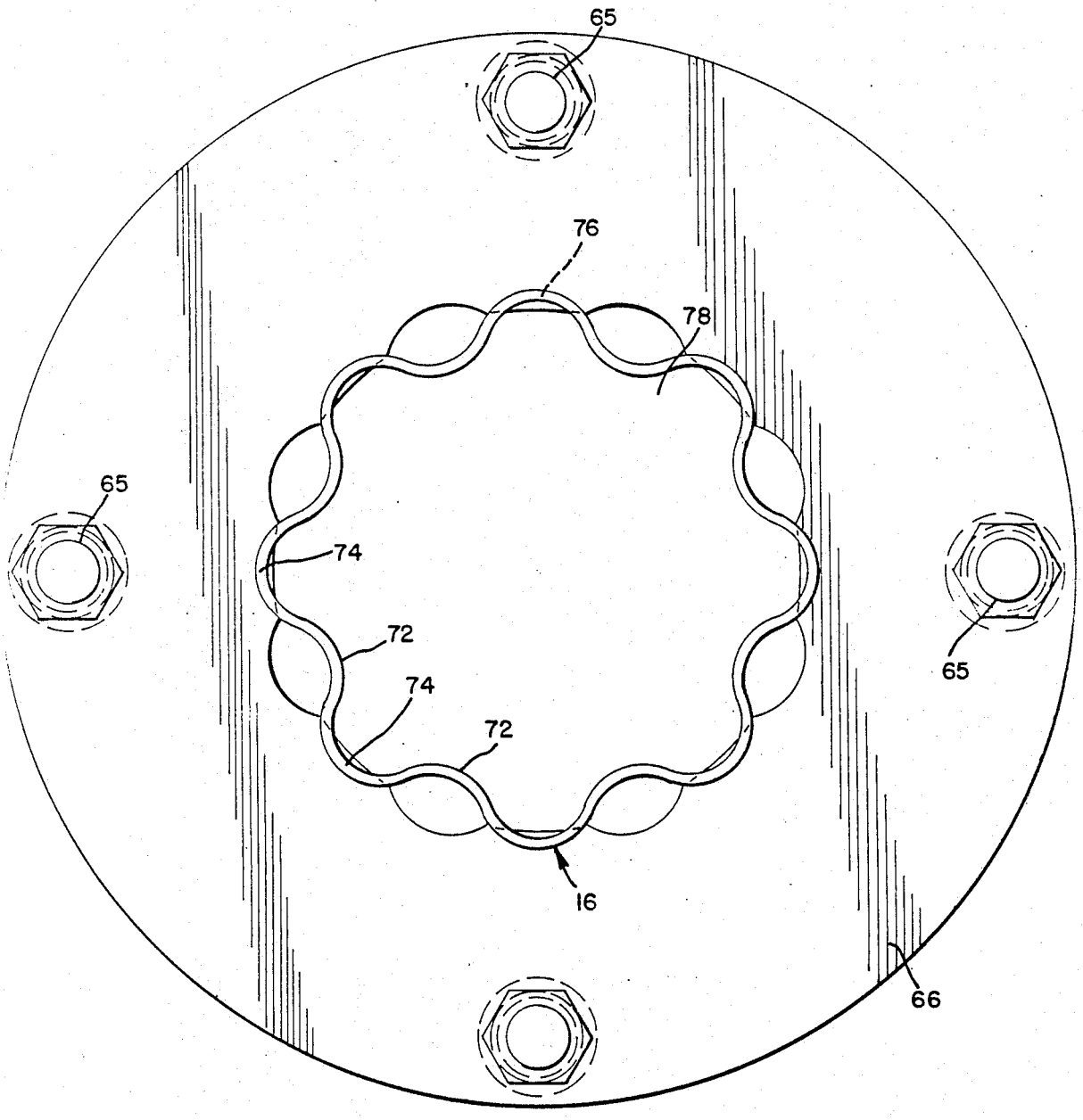
FIG. 2 is an enlarged top view of a central portion of the apparatus shown in FIG. 1.
Figure 3:
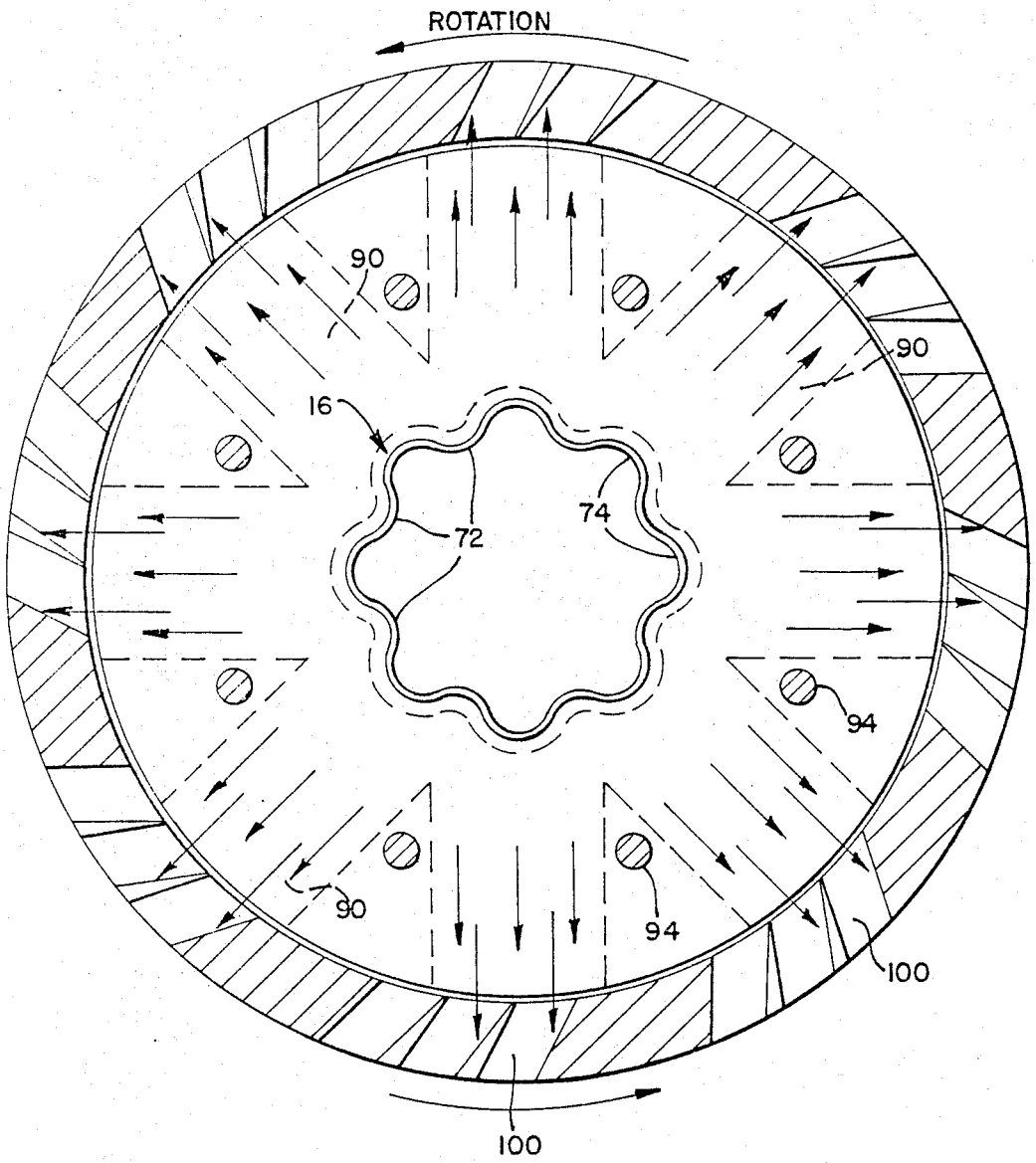
FIG. 3 is a cross sectional view taken on Line 3—3 of FIG. 1.

Sleeve 16 is a thin wall elongated cylinder made of copper for excellent heat transfer efficiency. As may be seen in FIGS. 2 and 3, sleeve 16 has a corrugated outer surface and a corrugated inner surface. The interior of the mold sleeve is a continuous interior wall particularly adapted for engaging metal cast in the sleeve. The interior includes a plurality of elongated rounded wall ridges 72 which are equiangularly spaced. The ridges are eight in number. The sleeve also has a plurality of rounded wall indentations 74 equal in number to the number of ridges and positioned between the ridges. The mold sleeve is a thin wall cylinder wherein the thickness of the cylinder wall is uniform. The sleeve is adapted for transferring heat efficiently and is made of a heat conductive material. The sleeve is made of copper, although any other suitable material may be used for specific applications.

The interior indentations 74 which are ridges on the exterior of the sleeve, each have a slot 76 cut therein to receive support disk 66 and lock the sleeve to the support disk. As may be seen in FIG. 2, support disk 66 contains an aperture 78 which is similar in shape to the exterior surface of sleeve 16. The sleeve is positioned within the aperture 78 with disk 66 aligned with the plane of the slots, then the sleeve is rotated relative to disk 66 to place portions of the support disk into the slots and thereby lock disk 66 to the sleeve. The support disk's four mounting apertures align with the guide pin recess 58 and receive the guide pins. The locater disk is prevented from rotation by the guide pins. The sleeve is prevented from rotating by the guide disk 68 which is mounted to the header 54.

Coolant outlet control 20 includes a control support plate 82 which is mounted on the end of jacket 18. Jacket 18 includes a second annular lock ring groove 84 which has a second lock ring 86 mounted therein. Second lock ring 86 retains the control support plate onto the jacket. A ring-like retainer 88 is mounted on the end of the jacket. Retainer 88 is secured to support plate 82 by a plurality of machine screws 89. The retainer includes a plurality of radial apertuers 90. There are eight equiangularly spaced apertures 90 in the retainer. The width of the apertures 90 is substantially equal to the distance between the apertures on the outer periphery of the retainer. A retainer plate 92 is positioned below the retainer and is connected to the retainer by bolts 94. A deflector ring 96 is positioned within the retainer adjacent to the lower end of sleeve 16.

The coolant outlet control includes a pulsing ring 98 which is rotatably mounted on retainer 88. The pulsing ring has eight sets of three nozzles 100 in the lower edge of the ring. The nozzles are all set at the same angle to the radius of the ring. The distance between the outermost edges of each set of three nozzles 100 at the interior of the pulsing ring is substantially equal to the width of each of the apertures 90 so that the nozzles may be perfectly aligned with the apertures and then slowly the apertures are closed as the pulsing ring rotates relative to the retainer.

The jacket support plate 40 has a plurality of threaded pipe apertures 102 formed therein which receive coolant inlet assembly 19. The coolant assembly includes conventional pipe connectors 104 threadedly mounted in pipe apertures 102. Pipe connectors 104 are connected to flexible water hoses 106. Head 54 includes an annular cavity 108 which communicates with apertures 102. Cavity 108 is ring-like and communicates with a ring-like passage 110 which in turn communicates with a ring-like opening 112 which receives an end 114 of jacket 18. The interior of jacket 18 is slightly larger than and similar to the exterior of sleeve 16 thereby providing a coolant flow path between the jacket and the sleeve.

A conventional coolant, water in this instance, is pumped by a conventional pump into hoses 106 where the water is delivered to cavity 108 and flows around end 114 of the jacket to flow along the outer surface of the sleeve and adjacent to the inner surface of the jacket. The coolant water flows downward until the water engages deflector ring 96 where a major portion of the coolant is directed into apertures 90 and a minor portion of the coolant by-passes the deflector 96 and passes downwardly between the deflector 96 and the sleeve 16. The water flows out of the apertures 90 and into engagemen with the pulsing ring. When nozzles 100 are aligned with apertures 90, there is a flow of water out of all of the apertures. However, the flow of water through the nozzles causes the pulsing ring to rotate in a counterclockwise direction as viewed in FIG. 3. As the ring nozzles of each set align with the apertures, there is a slight back pressure within the coolant jacket but when the nozzles are no longer aligned with the apertures, the back pressure reaches a maximum in the coolant jacket to squeeze the casting sleeve. As the pulsing ring continues to rotate, and the nozzles come into alignment with the apertures, the pressure within the coolant jacket is relieved and the pressure on the sleeve is relieved so that the sleeve is under reduced pressure and may expand. The rotation of the pulsing ring causes a rhythmic pulsing pressure to occur within the coolant jacket and apply a pulsing pressure to the sleeve.

As was mentioned above, the molten metal is poured into the upper end of mold sleeve 16. The molten metal engages the sleeve and is chilled by the transfer of heat from the metal to the sleeve and to the coolant. The heat is carried away by the coolant. As is conventional in continuous casting of metal, the metal adjacent to the casting sleeve is chilled and becomes solidified while the interior is still molten. As the metal progresses through the sleeve, more and more heat is dissipated and the thickness of the solidified shell progressively increases. When the elongated bar leaves the sleeve, there is substantial solidified metal so that the withdrawal rolls then can pull on the elongated bar. The bar is cooled continuously after leaving the sleeve by a plurality of nozzles, such as, nozzles 26.

The sleeve is movable relative to the cast metal. In the instant apparatus, the wall of the sleeve is corrugated so that there can be a sufficient constriction of the sleeve to engage the metal and move with the metal cooling the exterior metal of the bar. When the pressure is relieved, the sleeve expands and the support springs then pull the sleeve against the direction of movement of the metal. The movement is quite small but is repeated with a high degree of frequency so that the constant collapsing of the sleeve and relieving of the sleeve allows the sleeve to engage the metal and transfer the heat while the sleeve is moving with the metal. Then, there is a relief of the pressure to allow the sleeve to expand. When the sleeve expands, the support springs which have been compressed by movement of the sleeve pull the sleeve upward against the direction of the motion of the metal. Then the sleeve repeats its engagement with the metal within the sleeve. This high frequency cyclic action of repeated compression and release of the sleeve along with the corresponding longitudinal oscillations of the sleeve minimizes frictional drag between the casting and the sleeve and thus minimizes tensile fracture of the shell of the casting during initial solidification.

The passage of the metal through sleeve 16 eventually wears away the sleeve so that it is necessary to replace the sleeve. The replacement of the sleeve in the instant apparatus is a simple matter. The support disk 66 along with guide pins 62, retainers 60, and springs 64, are lifted as a unit from the header 54, thus removing the sleeve 16 from the jacket 18. The support disk is then rotated relative to the sleeve so that the sleeve may be removed through aperture 78. A new sleeve identical to used sleeve 16 is inserted in aperture 78. The support disk is rotated so that the support disk fits into slots 76 of the new sleeve 16. The sleeve with the support disk is then inserted into the jacket 18 and the apparatus is ready for operation. It may be appreciated that this replacement of the sleeve can be done with a minimum of down time of the apparatus and a minimum of cost to the operator. The sleeve is a thin wall cylinder which is relatively inexpensive to manufacture and produce. Although a sleeve having corrugations has been disclosed herein, it is readily apparent that other configurations may be used instead of the instant sleeve.

In view of the fact that sleeve 16 is a thin wall cylinder, it may not take any substantial side loading. The sleeve is made of copper which is a relatively soft material. It is desirable for the sleeve to have a uniform space between the sleeve and the coolant jacket to have a uniform distribution of coolant around the sleeve. The withdrawal rolls 24 pull casting 22 downward; however, in certain instances, there is a tendency for the casting to be shifted in one direction or another. In order to eliminate any side loading on the sleeve, jacket support plate 40 is movably mounted in attachment ring 34. The beveled faces of jacket support plate 40 and attachment ring 34 allows header 54 to pivot and thereby allows the sleeve to accommodate itself to casting 32. This construction allows a thin wall sleeve to be utilized and still allow efficient operation of the sleeve. It may be seen that the sleeve and the associated apparatus then floats in order to accommodate the sleeve to side loadings on the sleeve with the casting. As was mentioned above, the supply of coolant enters the apparatus through flexible hoses 106 so that the adjustment by the apparatus to accommodate the sleeve to the casting is not hindered. The utilization of the coolant for a dual purpose of cooling the material within the sleeve and for compressing the sleeve when the back pressure is caused to build up provides an efficient operation which includes the advantage of allowing the apparatus to adjust itself to variations in the casting relative to the withdrawal rolls.

From the foregoing description, it may be seen how the molten metal enters the upper end of sleeve 16 and is chilled by the coolant flowing adjacent to the sleeve. The metal adjacent to the sleeve solidifies and the metal is continuously chilled within the sleeve while the metal in the interior of the casting still may remain a liquid. As the metal moves downward relative to the sleeve toward the rolls, it is being rhythmically compressed within the sleeve and chilled so that the solidified metal is of a sufficient thickness so that when it engages withdrawal rolls 24, there is virtually no likelihood of rupture of the casting. Thus, the casting has excellent surface quality requiring minimum surface conditioning for acceptable finished product.

Although a specific embodiment of the herein disclosed invention has been shown in the accompanying drawings and described in detail hereinabove, it is readily apparent that those skilled in the art may make various modifications and changes in the construction of the instant apparatus and in the method described herein without departing from the spirit and scope of the present invention. It is to be expressly understood that the instant invention is limited only by the appended claims.

What is claimed is:

1. An apparatus for continuous casting of metal into an elongated bar comprising; an elongated vertical mold sleeve having an upper end and a lower end, said upper end being adapted for receiving molten metal, said elongated vertical mold sleeve is an elongated open end cylinder having an elongated longitudinal axis, means for cooling the sleeve for chilling metal within the sleeve to solidify the metal, means for moving solidified metal out of the lower end of the mold sleeve, said cylinder having a continuous interior side wall for engaging solidified metal in the cylinder while said metal moves substantially parallel to the elongated longitudinal axis during casting, a plurality of corrugations formed in the interior side wall substantially parallel to the elongated longitudinal axis, means for intermittently applying pressure to the exterior of the sleeve for compressing the sleeve to place the interior of the sleeve into frictional engagement with solidified metal within the sleeve, said interior side wall determining the exterior cross sectional dimension of the solidified metal when the sleeve is compressed, means to allow the sleeve to move with the solidified metal in the sleeve when the sleeve is compressed and is in frictional engaement with the solidified metal, means for intermittently relieving the pressure on the sleeve to allow the sleeve to expand radially and to disengage substantially frictional engagement with the solidified metal, and means for moving the mold sleeve relative to solidified metal within the sleeve in a direction opposite to the direction of movement of the solidified metal when the pressure on the sleeve is relieved.

2. An apparatus for continuous casting of metal into an elongated bar as defined in claim 1, wherein the elongated vertical mold sleeve is a thin wall cylinder.

3. An apparatus for continuous casting of metal into an elongated bar as defined in claim 1, wherein said means for cooling the sleeve includes water flowing along substantially the entire length of the mold sleeve in the direction of movement of the solidified metal.

4. An apparatus for continuous casting of metal into an elongated bar as defined in claim 1, wherein the means for cooling the sleeve includes water flowing along substantially the entire length of the mold sleeve, and including a jacket having its interior similar in shape to the exterior of the mold sleeve to retain the water between the interior of the jacket and the exterior of the mold sleeve.

5. An apparatus for continuous casting of metal into an elongated bar as defined in claim 1, wherein the means for cooling the sleeve includes water under pressure flowing along substantially the entire length of the mold sleeve, and said means for intermittently compressing the sleeve includes a valve for intermittently interrupting the flow of water away from the mold sleeve to cause the pressure of the water to increase and thereby compress the sleeve.

6. An apparatus for continuous casting of metal into an elongated bar as defined in claim 1, wherein said means for moving the mold sleeve relative to the metal includes a spring connected to the sleeve.

7. An apparatus for continuous casting of metal into an elongated bar as defined in claim 1, including; a header assembly connected to the mold sleeve, said header assembly having a support surface, and a support ring having an inner support surface engageable with the support surface of the header assembly for supporting the header assembly and allowing the header assembly to tilt to allow the header assembly to adapt its positional attitute for a variety of loads on the header assembly.

8. An apparatus for continuous casting of metal into an elongated bar as defined in claim 1, wherein the elongated vertical mold sleeve is a thin wall cylinder, said means for cooling the sleeve includes water flowing along substantially the entire length of the mold sleeve, and including a jacket having its interior similar in shape to the exterior of the cylinder to retain the water between the interior of the jacket and the exterior of the cylinder.

9. An apparatus for continuous casting of metal into an elongated bar as defined in claim 1, wherein the elongated vertical mold sleeve is a thin wall cylinder, said means for cooling the sleeve includes water under pressure flowing along substantially the entire length of the mold sleeve, and said means for intermittently compressing the sleeve includes a valve for intermittently interrupting the flow of water away from the mold sleeve to cause the pressure of the water to increase and thereby compress the sleeve.

10. An apparatus for continuous casting of metal into an elongated bar as defined in claim 1, wherein the elongated vertical mold sleeve is a thin wall cylinder, and said means for moving the mold sleeve relative to the metal includes a spring connected to the thin wall cylinder.

11. An apparatus for continuous casting of metal into an elongated bar as defined is claim 1, wherein the elongated vertical mold sleeve is a thin wall cylinder, and including a header assembly connected to the thin wall cylinder, said header assembly having a support surface, and a support ring having an inner support surface engageable with the support surface of the header assembly for supporting the header assembly and allowing the header assembly to tilt to allow the header assembly to adapt its positional attitude for a variety of loads on the thin wall cylinder.

12. An apparatus for continuous casting of metal into an elongated bar as defined in claim 1, wherein the elongated vertical mold sleeve is a thin wall cylinder, including, a header assembly connected to the thin wall cylinder for supporting the thin wall cylinder, said header assembly having a support surface, a support ring having an inner support surface engageable with the support surface of the header assembly for supporting the header assembly and allowing the header assembly to tilt to allow the header assembly to adapt its positional attitude for a variety of loads on the thin wall cylinder, said means for cooling the sleeve includes water under pressure flowing along substantially the entire length of the thin wall cylinder, and said means for intermittently compressing the sleeve includes a valve for intermittently interrupting the flow of water away from the thin wall cylinder to cause the pressure of the water to increase and thereby compress the thin wall cylinder.

13. An apparatus for continuous casting of metal into an elongated bar as defined in claim 1, including a header assembly connected to the mold sleeve, said means for moving the mold sleeve relative to the metal includes a spring connected to the mold sleeve and the header assembly for moving the mold sleeve along its length relative to the header assembly, said header assembly having a support surface, a support ring having an inner support surface engageable with the support surface of the header assembly for supporting the header assembly and allowing the header assembly to tilt to allow the header assembly to adapt its positional attitude for a variety of loads on the mold sleeve, a jacket mounted on the header assembly and having its interior similar in shape to the exterior of the mold sleeve, said jacket having its interior spaced from the exterior of the mold sleeve to form a space therebetween, said means for cooling the sleeve including water under pressure flowing along substantially the entire length of the mold sleeve in the space between the exterior of the mold sleeve and the interior of the jacket, and said means for intermittently compressing the sleeve including a valve for intermittently interrupting the flow of water out from the space between the exterior of the mold sleeve and the interior of the jacket to cause the pressure of water in said space to increase and thereby compress the mold sleeve.

14. An apparatus for continuous casting of metal into an elongated bar comprising; an elongated vertical mold sleeve having an upper end and a lower end, said upper end being adapted for receiving molten metal, a jacket having an interior similar in shape to the exterior of the mold sleeve surrounding the mold sleeve and having a space between the exterior of the mold sleeve and the interior of the jacket, means for cooling the sleeve for chilling metal within the sleeve to solidify the metal, means for moving solidified metal out of the lower end of the mold sleeve, said means for cooling the sleeve including water flowing between the exterior of the mold sleeve and the interior of the jacket substantially along the entire length of the mold sleeve, means for intermittently compressing the sleeve to place the interior of the sleeve into frictional engagement with the metal within the sleeve, said means for intermittently compressing the sleeve including a rotating valve controlling the flow of water out from between the exterior of the sleeve and the interior of the jacket, said rotating valve having a plurality of apertures to cause the valve to rotate and thereby intermittently interrupt the flow of water to compress intermittently the sleeve, and means for moving the mold sleeve relative to the metal within the sleeve in a direction opposite to the direction of movement of the solidified metal.

15. An apparatus for continuous casting of metal into an elongated bar comprising; an elongated vertical mold sleeve having an upper end and a lower end, said upper end being adapted for receiving molten metal, a jacket having an interior surface similar in shape to the exterior surface of the mold sleeve, said jacket surrounding the mold sleeve and having a space between the exterior of the mold sleeve and the interior of the jacket, means for cooling the sleeve for chilling metal within the sleeve to solidify the metal, means for moving solidified metal out of the lower end of the mold sleeve, means for intermittently compressing the sleeve to place the interior of the sleeve into frictional engagement with the metal within the sleeve, means for moving the mold sleeve relative to the metal in the sleeve in a direction opposite to the direction of movement of the solidified metal, said means for moving the mold sleeve relative to the metal including a spring connected to the mold sleeve, said means for cooling the sleeve including water under pressure flowing in the space between the exterior of the mold sleeve and the interior of the jacket substantially along the entire length of the mold sleeve, said means for intermittently compressing the sleeve including a rotating valve controlling the flow of water out of the space between the exterior of the sleeve and the interior of the jacket, and said rotating valve having a plurality of apertures to cause the valve to rotate and thereby intermittently interrupt the flow of water out of the space to increase the pressure of the water in the space to compress intermittently the mold sleeve.

16. An apparatus for continuous casting of metal into an elongated bar comprising; an elongated vertical mold sleeve having an upper end and a lower end, said upper end being adapted for receiving molten metal, a header assembly connected to the mold sleeve, said header assembly having a support surface, a support ring having an inner support surface engageable with the support surface of the header assembly for supoprting the header assembly and allowing the header assembly to tilt to allow the header assembly to adapt its positional attitude for a variety of loads on the mold sleeve, a jacket having an interior similar in shape to the exterior of the mold sleeve surrounding the mold sleeve and having a space between the exterior of the mold sleeve and the interior of the jacket, said jacket being supported on the header assembly for tilting with the header assembly and the mold sleeve, means for cooling the sleeve for chilling metal within the sleeve to solidify the metal, means for moving solidified metal out of the lower end of the mold sleeve, means for intermittently compressing the interior of the sleeve into frictional engagement with the metal within the sleeve, said means for cooling the sleeve including water under pressure flowing in the space between the exterior of the mold sleeve and the interior of the jacket substantially along the entire length of the mold sleeve, said means for intermittently compressing the sleeve including a rotating valve controlling the flow of water out from the space between the exterior of the sleeve and the interior of the jacket, said rotating valve having a plurality of apertures to cause the valve to rotate and thereby intermittently interrupt the flow of water from the space to cause the pressure to increase to compress intermittently the sleeve, and means for moving the mold sleeve relative to the metal within the sleeve in a direction opposite to the direction of movement of the solidified metal.

17. An apparatus for continuous casting of metal into an elongated bar comprising; an elongated vertical mold sleeve having an upper end and a lower end, said upper end being adapted for receiving molten metal, means for cooling the sleeve for chilling metal within the sleeve to solidify the metal, means for moving solidified metal out of the mold sleeve, a header assembly connected to the mold sleeve, said means for moving the mold sleeve relative to the metal includes a spring connected to the mold sleeve and to the header assembly for moving the mold sleeve relative to the header assembly, said header assembly having a support surface, a support ring having an inner support surface engageable with the support surface of the header assembly for supporting the header assembly and allowing the header assembly to tilt to allow the header assembly to adapt its positional attitude for a variety of loads on the mold sleeve, a jacket having an interior similar in shape to the exterior of the mold sleeve surrounding the mold sleeve and having a space between the exterior of the mold sleeve and the interior of the jacket, said means for cooling the sleeve including water flowing under pressure in the space between the exterior of the mold sleeve and the interior of the jacket substantially along the entire length of the mold sleeve, means for intermittently compressing the sleeve to place the interior of the sleeve into frictional engagement with the metal within the sleeve, said means for intermittently compressing the sleeve including a rotating valve controlling the flow of water out from the space between the exterior of the sleeve and the interior of the jacket, said rotating valve having a plurality of apertures to cause the valve to rotate and thereby intermittently interrupt the flow of water out of the space to increase the pressure of the water to compress intermittently the sleeve, and means for moving the mold sleeve relative to the metal within the sleeve in a direction opposite to the direction of movement of the solidified metal.

18. An apparatus for continuous casting of metal into an elongated bar comprising; an elongated vertical mold sleeve being a thin wall cylinder and having an upper end and a lower end, said upper end being adapted for receiving molten metal, means for cooling the sleeve for chilling metal within the sleeve to solidify the metal, means for moving solidified metal out of the lower end of the mold sleeve, means for intermittently compressing the sleeve to place the interior of the sleeve into frictional engagement with the metal into the sleeve, means for moving the mold sleeve relative to the metal within the sleeve in a direction opposite to the movement of solidified metal, a header assembly connected to the thin wall cylinder, said means for moving the mold sleeve relative to the metal includes a spring connected to the thin wall cylinder and the header assembly for moving the thin wall cylinder relative to the header assembly, said header assembly having a support surface, a support ring having an interior support surface engageable with the support of the header assembly for supporting the header assembly and allowing the header assembly to tilt and to allow the header assembly to adapt its positional attitude for a variety of loads on the thin wall cylinder, a jacket having an interior similar in shape to the exterior of the thin wall cylinder surrounding the thin wall cylinder and having a space between the exterior of the thin wall cylinder and the interior of the jacket, said means for cooling the sleeve including water under pressure flowing in the space between the exterior of the thin wall cylinder and the interior of the jacket, said means for intermittently compressing the sleeve including a rotating valve controlling the flow of water out from the space between the exterior of the thin wall cylinder and the interior of the jacket, and said rotating valve having a plurality of apertures to cause the valve to rotate and thereby intermittently interrupt the flow of water out of said space to increase the pressure of the water in the space to compress intermittently the sleeve.

19. An apparatus for continuous casting of metal into an elongated bar comprising; an elongated vertical mold sleeve having an upper end and a lower end, said upper end being adapted for receiving molten metal, means for cooling the sleeve for chilling metal within the sleeve to solidify the metal, means for moving solidified metal out of the lower end of the mold sleeve, means for moving the mold sleeve relative to the metal within the sleeve in a direction opposite to the direction of movement of the solidified metal, the mold sleeve is an elongated open ended cylinder having an elongated longitudinal axis, said cylinder having a continuous interior side wall for engaging metal cast in the cylinder while said metal moves substantially parallel to the elongated longitudinal axis during casting, a plurality of elongated rounded wall ridges formed in the interior side wall for forming rounded bar indentations in the metal cast in the cylinder, a plurality of elongated rounded wall indentations formed in the interior side wall for forming rounded bar ridges in metal cast in the cylinder, each of said rounded wall indentations in the interior side wall being positioned between a pair of rounded wall ridges in the interior side wall, a header assembly connected to the upper end of the cylinder, said means for moving the mold sleeve relative to the metal including a spring connected to the upper end of the cylinder and to the header assembly for moving the cylinder along its longitudinal axis, said header assembly having a support surface, a support ring having an inner support surface engageable with the support surface of the header assembly for supporting the header assembly and allowing the header assembly to tilt to allow the header assembly to adapt its positional attitude for a variety of loads on the open ended cylinder, a jacket having an interior similar in shape to the exterior of the open ended cylinder surrounding the open ended cylinder and having a space between the exterior of the open ended cylinder and the interior of the jacket, said means for cooling the sleeve including water flowing between the exterior of the open ended cylinder and the interior of the jacket sustantially along the entire length of the open ended cylinder, said means for intermittently compressing the sleeve including a rotating valve controlling the flow of water out from the space between the exterior of the open cylinder and the interior of the jacket, and said rotating valve having a plurality of apertures to cause the valve to rotate and thereby intermittently interrupt the flow of water out of the space to increase the pressure of the water in the space to compress intermittently the sleeve.

20. An apparatus for continuous casting of metal into an elongated bar comprising; an elongated vertical mold sleeve having an upper end and a lower end, said upper end being adapted for receiving molten metal, means for cooling the sleeve for chilling metal within the sleeve to solidify the metal, means for moving solidified metal out of the lower end of the mold sleeve, means for intermittently compressing the sleeve to place the interior of the sleeve into frictional engagement with the metal within the sleeve, means for moving the mold sleeve relative to the metal within the sleeve in a direction opposite to the direction of movement of the solidified metal, said elongated vertical mold sleeve is an elongated open ended cylinder having an elongated longitudinal axis, said cylinder being a thin wall copper cylinder having a uniform wall thickness, said cylinder having a continuous interior side wall for engaging metal cast in the cylinder while said metal moves substantially parallel to the elongated longitudinal axis during casting, a plurality of elongated rounded wall ridges formed in the interior side wall for forming rounded bar indentations in metal cast in the cylinder, a plurality of elongated rounded wall indentations formed in the interior side wall for forming rounded bar ridges in metal cast in the cylinder, each of said rounded wall indentations in the interior side wall being positioned between a pair of rounded wall ridges in the interior side wall, said rounded wall ridges in the interior side wall being equiangularly spaced, a slot extending through each rounded indentation, each slot being formed in the outer surface of the cylinder, all of said slots being in the same plane, a disk releasably positioned in the slots for releasably locking the cylinder to the disk, said means for moving the mold sleeve relative to the metal includes a spring connected to the disk, a header assembly connected to the spring, said header assembly having a support surface, a support ring having an inner support surface engageable with the support surface of the header assembly for supporting the header assembly and allowing the header assembly to tilt to allow the header assembly to adapt its positional attitude for a variety of loads on the open ended cylinder, a jacket mounted on the header assembly and having an interior similar in shape to the exterior of the open ended cylinder and having a space between the exterior of the open ended cylinder and the interior of the jacket, said means for cooling the sleeve including water under pressure flowing in the space between the exterior of the open ended cylinder and the interior of the jacket substantially along the entire length of the open ended cylinder, said means for intermittently compressing the sleeve including a rotating valve controlling the flow of water out from the space between the exterior of the open ended cylinder and the interior of the jacket, said rotating valve having a plurality of apertures to cause the valve to rotate and thereby intermittently interrupt the flow of water from the space between the cylinder and the jacket to allow the pressure of the water to buildup and thereby compress intermittently the cylinder.

21. A method of continuous casting of metal into an elongated bar comprising the steps of; pouring molten metal into a thin wall mold sleeve, pumping a coolant under pressure into a jacket surrounding the mold sleeve to contact the exterior of the mold sleeve, cooling the molten metal in the mold sleeve to solidify the metal in the mold sleeve, pulling the solidified metal out of the mold sleeve, interrupting intermittently the flow of coolant out of the jacket to increase the pressure of the coolant in the jacket to compress the mold sleeve for the sleeve to increase intermittently frictional engagement with the metal within the sleeve for the sleeve to move with the metal, relieving intermittently the pressure of the coolant in the jacket to allow the sleeve to reduce the frictional engagement of the sleeve with the metal in the sleeve, and moving intermittently the sleeve in the direction opposite to the direction of movement of the metal.

22. A method of continuous casting of metal into an elongated bar as defined in claim 21, wherein the thin wall mold sleeve has an interior corrugated surface with the corrugations aligned with the length of the sleeve and with the direction of movement of the metal.

23. A method of continuous casting of metal into an elongated bar as defined in claim 21, wherein the increase and relief of pressure of the coolant in the jacket is rapid.

24. A method of continuous casting of metal into an elongated bar as defined in claim 21, wherein the mold sleeve moves a short distance with the metal within the sleeve before the frictional engagement between the metal and the sleeve is reduced and the sleeve then moves opposite to the direction of movement of the metal.

25. A method of continuous casting of metal into an elongated bar as defined in claim 21, wherein the thin wall mold sleeve has an interior corrugated surface with the corrugations aligned with the length of the sleeve and with the direction of movement of the metal, and the increase and relief of pressure of the coolant in the jacket is rapid.

26. A method of continuous casting of metal into an elongated bar as defined in claim 21, wherein the thin wall mold sleeve has an interior corrugated surface with the corrugations aligned with the length of the sleeve and with the direction of movement of the metal, said increase and relief of pressure of the coolant in the jacket is rapid, and the mold sleeve moves a short distance with the metal in the sleeve before the frictional engagement of the metal and the sleeve is reduced and the sleeve moves opposite to the direction of movement of the metal.

* * * * *

UNITED STATES PATENT AND TRADEMARK OFFICE

CERTIFICATE OF CORRECTION

PATENT NO. : 4,726,416

DATED : Feb. 23, 1988

INVENTOR(S) : James N. Wognum

It is certified that error appears in the above-identified patent and that said Letters Patent are hereby corrected as shown below:

Column 2, line 35, cancel "an" and substitute therefor --and--

Column 4, line 10 cancel "supoort" and substitute therefor --support--

Column 5, line 32 cancel "engagemen" and substitute therefor --engagement--

Claim 1, column 7, line 33 cancel "end" and substitute therefor --ended--

Claim 1, column 7, lines 50 and 51 cancel "engaement" and substitute therefor --engagement--

Claim 18, column 11, line 61 after "the support" insert --surface--

Claim 20, column 13, line 25 after "rounded" insert --wall--

Signed and Sealed this

Twelfth Day of July, 1988

*Attest:*

*Attesting Officer*

DONALD J. QUIGG

*Commissioner of Patents and Trademarks*